United States Patent [19]

Meuwly et al.

[11] Patent Number: 4,571,916

[45] Date of Patent: Feb. 25, 1986

[54] SECONDARY PACKAGING MACHINE

[75] Inventors: Michael S. Meuwly, West Monroe; James A. Roberts, Monroe; James F. Gilbert, West Monroe, all of La.; Daniel V. Clavert, Grand Junction, Colo.; James B. P. Green, Jr., West Monroe, La.

[73] Assignee: Southern Tool Company, West Monroe, La.

[21] Appl. No.: 558,729

[22] Filed: Dec. 5, 1983

[51] Int. Cl.[4] ..... B65B 11/10; B65B 49/04; B65B 7/20

[52] U.S. Cl. ..... 53/48; 53/543; 53/209; 53/374; 198/425

[58] Field of Search ..... 53/48, 209, 543, 374; 198/474, 485, 425

[56] References Cited

U.S. PATENT DOCUMENTS

| | | | |
|---|---|---|---|
| 2,678,151 | 5/1954 | Geisler | 53/54 |
| 3,016,663 | 1/1962 | Holmes et al. | 53/209 |
| 3,454,149 | 7/1969 | Nigrelli et al. | 53/209 |
| 3,516,219 | 6/1970 | Nigrelli et al. | 53/48 |
| 3,626,660 | 12/1971 | Dorfmann | 53/209 |
| 4,047,625 | 9/1977 | Grant | 198/485 |

*Primary Examiner*—Horace M. Culver
*Attorney, Agent, or Firm*—Bachman & LaPointe

[57] ABSTRACT

A machine for segregating and packaging a plurality of articles in a wrap-around carton first separates a selected number of articles from those on an infeed conveyor, brings the selected articles together with an opened carton blank, and wraps and secures the carton blank about the articles.

3 Claims, 12 Drawing Figures

16
110
88'
86'
28
26
62
54
30
50
32
22
32
94
88
92
48
86
26
28

88'
28
110
112
88'
62
22
28
86'
54
48
30
50
26
88
86

16
114'
114
112
110
88'
28
28
120
122
86'
22
30
54
26
88
50
86
116
118
48

18
88'
122
120
28
28
88
110
22
26
48
54
86
50
30

SECONDARY PACKAGING MACHINE

BACKGROUND OF THE INVENTION

This invention relates to secondary packaging and in particular to a machine for packaging a plurality of articles or containers in a wrap-around carton.

Beverages and other products are currently being marketed in aseptic containers which are formed with rectangular or square bases and sidewalls. These containers have been marketed in sets of three containers which are wrapped in a plastic film or taped together. The present invention is directed to a machine which will package three, six, nine, twelve or other selected numbers of containers in a wrap-around carton.

The machine segregates a selected number of containers from an infeed conveyor through an elevating plate which also functions to hold back the following containers. The containers are then conveyed through the machine by flight bars which are designed to contact the containers while clearing the carton as it is wrapped about the containers. As the containers are conveyed through the machine, an open carton blank is fed beneath the containers. The carton is wrapped about the conainers by means of tucking fingers and stationary folding bars and top panels of the carton are adhesively secured together to complete the packaging operation.

DETAILED DESCRIPTION OF THE INVENTION

Figure 1:
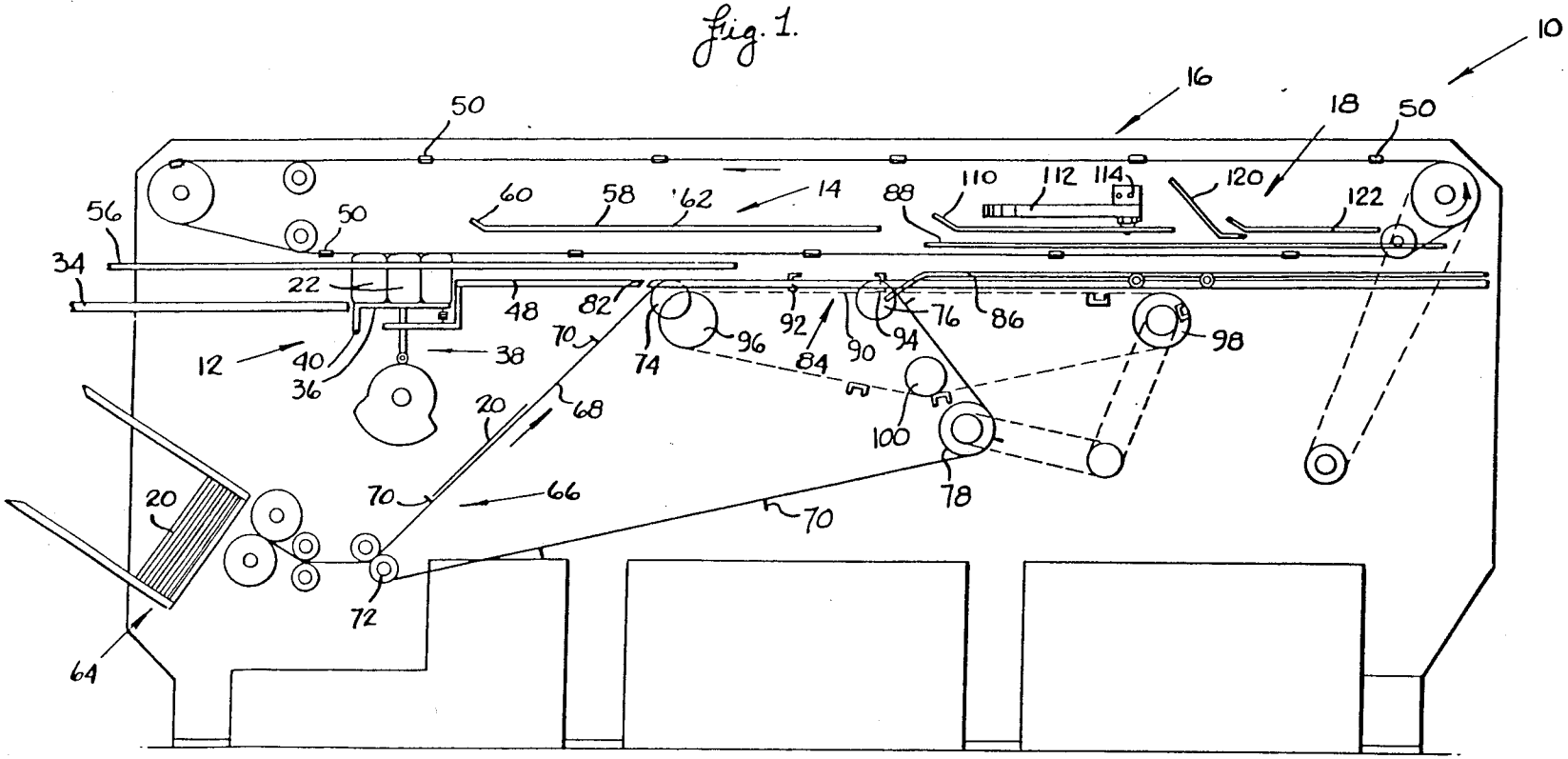
FIG. 1 is a schematic side elevation view of the machine of the present invention.
Figure 2:
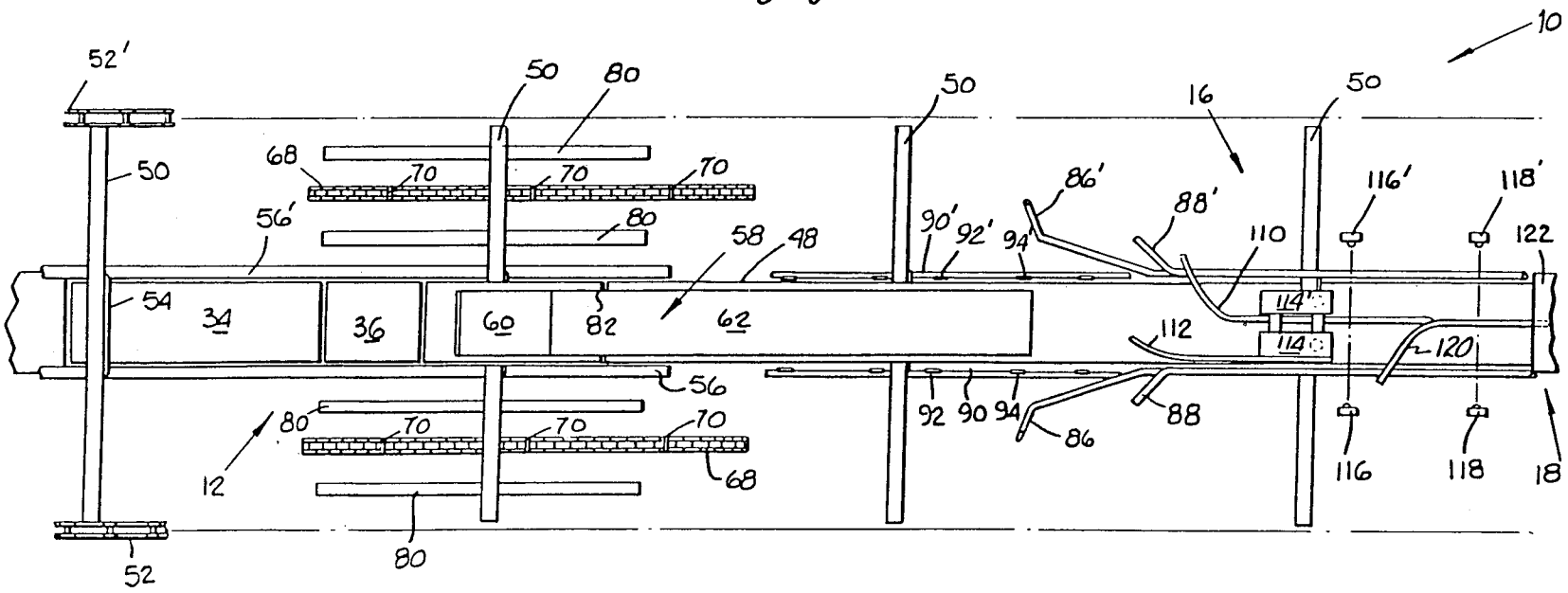
FIG. 2 is a schematic plan view of the machine shown in FIG. 1.

Referring now to FIGS. 1 and 2 of the drawings, the secondary packaging machine 10 is schematically illustrated. The machine comprises an article or container segregating station 12, a carton blank infeed station 14, a carton wrapping and gluing station 16 and a carton sealing station 18.

The machine 10 is designed to wrap a carton 20 about a pre-selected number of articles or containers 22. The carton 20 comprises a bottom panel not shown; side panels 26, inner and outer top panels 28, end panels 30 and four pairs of tuck flaps 32 which connect the end panels to the side panels.

A conventional infeed conveyor 34 feeds the containers 22 into the container segregating station 12 of the packaging machine 10. The conveyor 34 is typically a series of rollers over which two, three or four rows of containers 22 are pushed by following containers as the containers exit from the container filling or charging station of the process line.

In the container segregating station 12, a predetermined number of containers 22 are separated from the following containers on the infeed conveyor 34 and positioned so that the selected containers can be conveyed through the machine. While the selected containers are being positioned, the following containers are held in position on the conveyor 34, ready to move into the container segregating station for the next cycle of the segregating mechanism.

Figure 3:
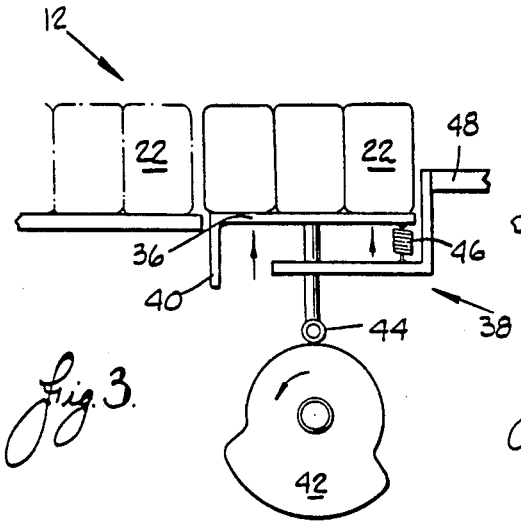
FIGS. 3 and 4 are side elevation views of the segragting elevator of the machine illustrating the elevator in its lowered and raised positions.
Figure 4:
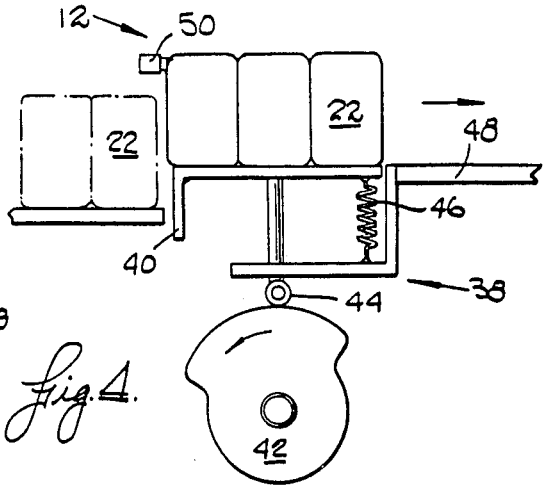

As best shown in FIGS. 3 and 4, the segregating mechanism comprises an elevator plate 36 which is raised and lowered by means of a cam mechanism 38. The elevator plate 36 has a width equal to the width of the rows of containers 22 being packaged. The length of the elevator plate 36 is less than the total length of the containers in each row which are to be segragated from the following containers. The elevator plate 36 has a downwardly extending stop plate 40 at its upstream edge. The stop plate 40 has a height greater than the lift of the elevator plate 36 so that its lower edge is not raised above the infeed conveyor 34 when the elevator plate is raised by the cam mechanism 38.

The cam mechanism 38 includes a rotating cam 42, a cam follower 44 that is connected to elevator plate 36 and a spring return 46. As shown in FIG. 3, the elevator plate 36 is in its lower position with its upper surface level with the infeed conveyor 34. In this position the cam follower 44 rides on the small radius portion of cam 42 and the spring return 46 is relaxed. As the cam 42 rotates in its counter clockwise direction the cam follower rides up onto the large radius portion of the cam 42 and the elevator plate is raised to its upper position shown in FIG. 4. In this position the upper surface of the elevator plate 36 is level with the upper surface of the bed plate 48 of the packaging machine 10 and the containers are in position to be conveyed through the machine by one of the flight bars 50. With the elevator plate in its upper position, the stop plate 40 is raised to hold the following containers 22 in place and the spring return 46 is extended and taut. As the cam 42 continues to rotate the follower rides back down onto the small radius portion of the cam. The spring return 46 holds the cam follower 44 on the cam as the cam follower returns to the small radius portion of the cam and ensures that the elevator plate returns to the position shown in FIG. 3. The segregating mechanism is ready for the next cycle where a succeeding set of containers to be segregated are loaded onto the elevator plate and then raised to the level of the bed plate 48 where they are engaged by the next flight bar 50.

The flight bars 50 are mounted on and extend between a pair of chains 52, 52'. The spacing of the flight bars 50 on the chains 52, 52' and the synchronization of the drive for chains 52 52' and the rotation of the cam 42 cause successive flight bars to engage the containers 22 once the containers are raised to the level of the bed plate 48 by the elevator plate 36. As shown in FIG. 2, each flight bar 50 has a centrally located container engaging section 54 which protrudes from the downstream side of the flight bar. The width of the container engaging section 54 is equal to or somewhat less than the total width of the rows of containers being packaged. With this construction the flight bars do not interfere with the wrapping of the carton 20 about the containers 22 as the flight bars convey the containers through the packaging machine.

Figure 5:
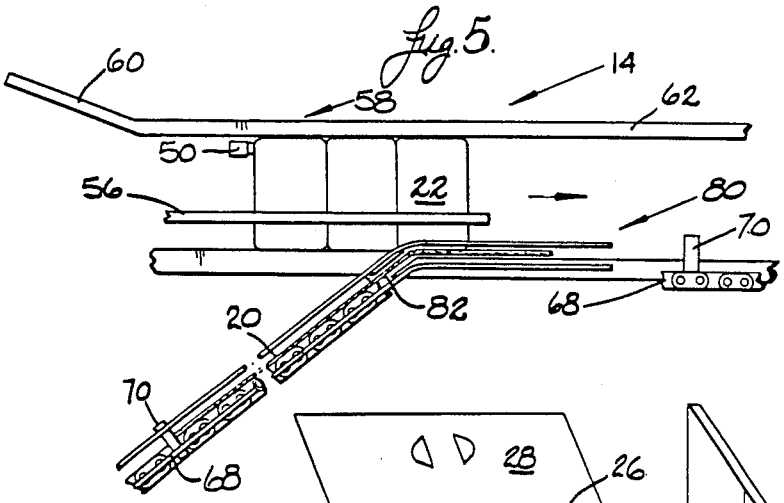
FIG. 5 is a side elevation view illustrating the blank infeed station of the machine.

As shown in FIG. 5, the flight bars 50 convey the selected containers 22 from the container segregating station 12 downstream over the bed plate 48 to the carton blank infeed station 14. As the containers are conveyed over the bed plate 48, the containers are maintained in position by guide rails 56, 56' and hold down plate 58. The guide rails 56, 56' are located over and extend parallel to the side edges of the bed plate 48 at a height above the bed plate equal to about one-third to one-half the height of the containers 22. The hold down plate 58 has an upstream portion 60 which converges toward the bed plate 48 and a main portion 62 which extends parallel to the bed plate at a height above the bed plate substantially equal to the heights of containers 22. With this construction, if any of the containers are tilted upward at one end or otherwise out of alignment the guide rails 56, 56' and the hold down plate 58 will properly align the containers before the containers reach the carton blank infeed station 14.

In the carton blank infeed station 14, open carton blanks 20 are introduced onto the bed plate 48 beneath the selected sets of containers 22. The carton blanks 20 to be used in the packaging operation are loaded into a hopper 64 such as the one schematically illustrated in FIG. 1. From the hopper 64 the carton blanks are individually fed to the chain conveyor 66 by a blank feed system such as the one illustrated in FIGS. 1A, 2A and 3A, 3B, 3C of U.S. Pat. No. 4,034,658. The disclosure of that patent is hereby incorporated by reference. While the blank feed system of U.S. Pat. No. 4,034,658 is preferred, other carton blank feed systems can be used.

The chain conveyor 66 includes a pair of chains 68, 68', and a series of spaced apart push lugs 70, 70', which are attached to the chains 68, 68'. The chains are spaced outwardly from the side edges of the bed plate and each chain runs over a series of sprockets 72, 74, 76 and 78 that guide the chain conveyor from the hopper blank feed system to the bed plate 48 where the chains 68, 68' and lugs 70, 70' run parallel to the upper surface of the bed plate.

The carton blank infeed station 14 is also provided with a series of five pairs of carton blank guide rails 80 which extend parallel to the chain runs between sprockets 72–74 and 74–76. Two of the pairs of guide rails 80 are located on either side of the bed plate 34 while the fifth pair of guide rails extends from sprocket 72 to sprocket 74 and is centered beneath the bed plate 48. As the carton blanks 20 are conveyed from the hopper blank feed system to the upper surface of the bed plate 48 by the chain conveyor 66, the blanks are held open and flat by the pairs of guide rails 80. The blanks are then fed through a slot 82 in the bed plate by the chain conveyor 66. As the carton blanks pass through the slot 82 the guide rails 80 bend the carton blanks and change the direction of travel of the carton blanks from an upward direction to a horizontal direction where the blanks travel on and parallel to the upper surface of the bed plate 48.

As best shown in FIG. 5, as the carton blanks are fed through the slot 82, the selected set of containers 22 are positioned on the bottom panel 24 of the carton blank. The carton blank in its open and flat condition and the containers 22 on the bottom panel of the carton blank now move together to the carton blank wrapping and gluing station 16.

As the flat, open carton blank and the selected containers enter the wrapping and gluing station, the side panels 26 and the partial end panels 30 are raised and the tuck flaps 32 are tucked between the side panels 26 and the containers 22 being packaged. This folding and tucking operation is accomplished by means of a tucking mechanism 84 and stationary folding bars 86, 86' and 88, 88'. The tucking mechanism 84 comprises a pair of driven chains 90, 90' having a series of pairs of tucking fingers 92, 92' and 94, 94' pivotally mounted thereon. The chains 90, 90' run over a series of sprockets 96, 98 and 100.

The run between sprockets 96 and 98 carries the chains 90, 90' parallel to and adjacent the side edges of the bed plate 34. Thus the tucking fingers 92, 92' and 94, 94' travel downstream adjacent the side edges of the bed plate. The speed of the chains 90, 90' and the location of the tucking fingers 92, 92' and 94, 94' on the chains are synchronized with the movement of the flight bars 50 and the lugs 70, 70' so that the tucking fingers 92, 92' and 94, 94' are positioned under the trailing and leading carton tuck flaps 32 respectively and move with the carton blank and the containers as they are conveyed downstream through the machine.

Figure 6:
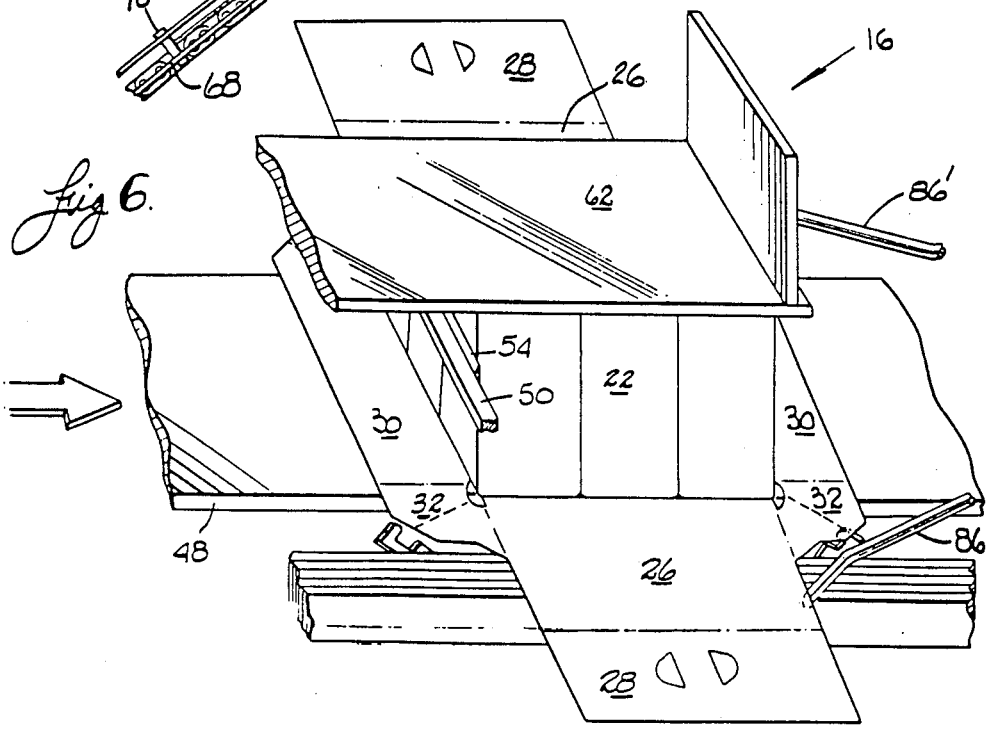
FIGS. 6 through 11 are perspective views of the carton wrapping and gluing station and the sealing station of the machine illustrating the formation of a wrap-around carton about a selected number of containers.
Figure 7:
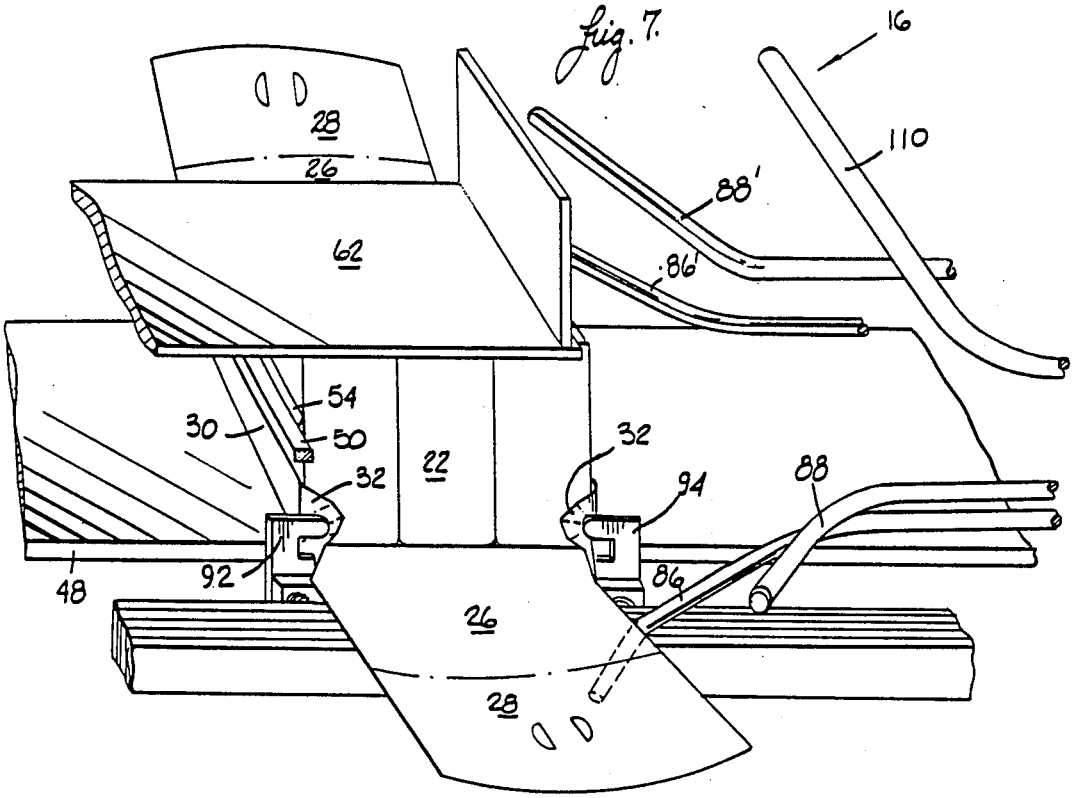
Figure 12:
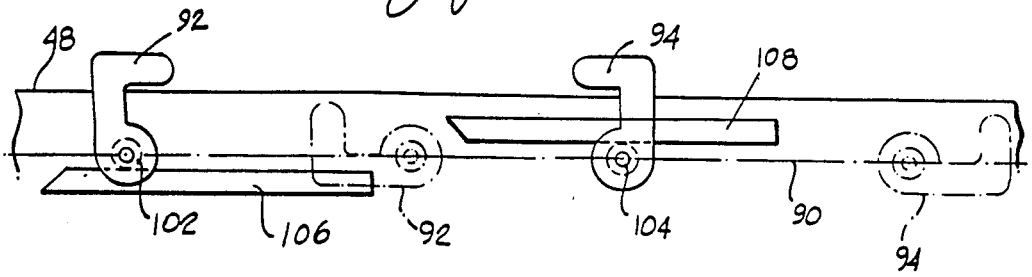
FIG. 12 is an elevation view of one set of the tucking fingers.

The trailing and leading tucking fingers 92, 92' and 94 94' are spaced from each other a distance substantially equal to the length of the side panels 26 of the carton 22. As best shown in FIG. 12, the tucking fingers each include a cam follower 102, 104 which raise the fingers to tuck in the flaps 32 when the cams 106 and 108 are engaged. Once the tucking fingers have passed over the cams 106 and 108, the fingers are returned to the positions shown in phantom line in FIG. 12. The tucking fingers are spring biased so that the return to their down position is rapid and positive. As shown in FIGS. 6 and 7, the folding bars 86, 86' and 88, 88' converge in the downstream direction toward the vertical planes of the side edges of the bed plate 48 and then extend parallel to and adjacent the planes of the side edges of the bed plate through the wrapping and gluing station and the sealing station. The folding bars 88, 88' are spaced downstream from the folding bars 86, 86' and are spaced above the folding bars 86, 86'.

Figure 8:
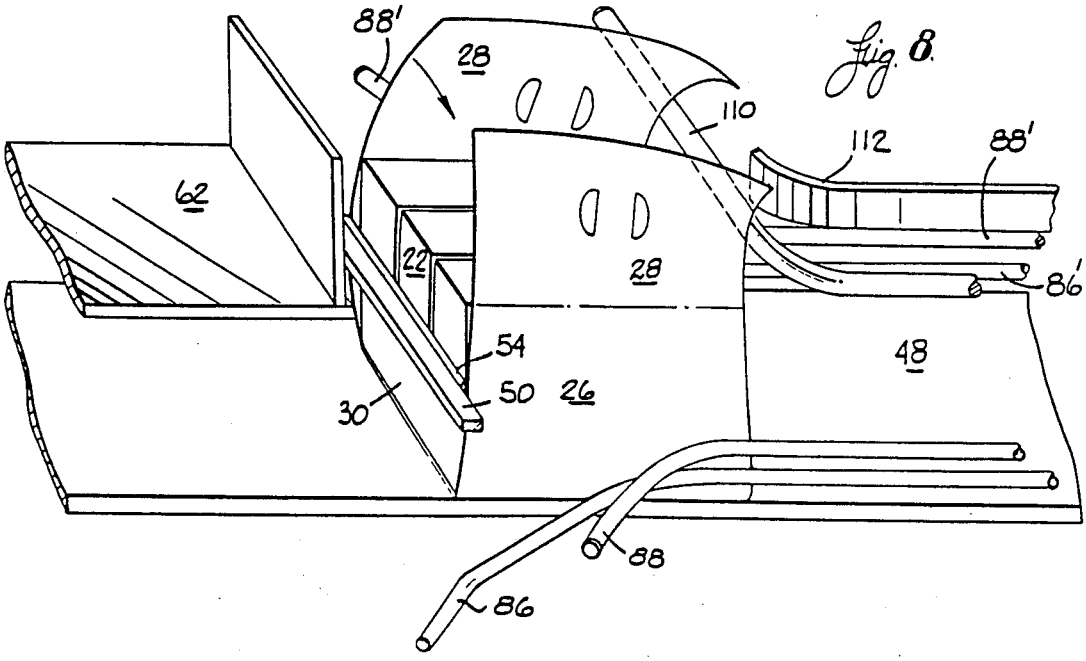

In FIGS. 6 and 7, the carton 20 and the selected containers 22 are shown as the tucking fingers 92, 92' and 94, 94' are just beginning to pivot upwardly and as the tucking fingers complete their upward movement. This causes the end panels 30 to be raised to a vertical position and raises the side panels 26. To facilitate the raising of the side panels 26, first stationary folding bars 86, 86' and then stationary folding bars 88, 88' engage the outer surfaces of the side panels as the carton moves downstream through the wrapping and gluing station. The combined action of the tucking fingers 92, 92' and 94, 94'and the folding bars 86, 86' and 88, 88' bring both the end panels 30 and the side panels 26 to their full upright positions as shown in FIG. 8. With the end panels 30 and the side panels 26 in their upright positions, the tuck flaps 32 are held between the side panels and the containers 22.

As shown in FIG. 8, after the end panels and side panels of the carton have been raised, the inner top panel is engaged by fold down bar 110 and the outer top panel is engaged by guide bar 112. The fold down bar 110 has a leading end which extends beyond the vertical side edge plane of the bed plate 34. The bar 110 extends downstream and downward from this leading end toward the center line of the bed plate 48. At substantially the center line of the bed plate 48 the fold down bar 110 extends parallel to the centerline of the bed plate at the height of the containers 22 through the wrapping and gluing station to the sealing station 18.

The guide bar 112 runs parallel to the vertical side edge plane of the bed plate at a height greater than the height of the containers 22. The leading end of the guide bar 112 extends inwardly toward the centerline of the bed plate and the main portion of the guide bar is adjacent but spaced inwardly from the plane of the side edge of the bed plate 48. With this construction, the outer surface of the inner top panel is engaged by the leading end portion of the fold down bar 110. As the carton is moved downstream, the fold down bar 110 folds the inner top panel down onto the containers 22 and holds the inner top panel in that position for the gluing operation. The inner surface of the outer top panel is engaged by the guide bar 112 which holds the outer top panel in a vertical position during the gluing operation.

Figure 9:
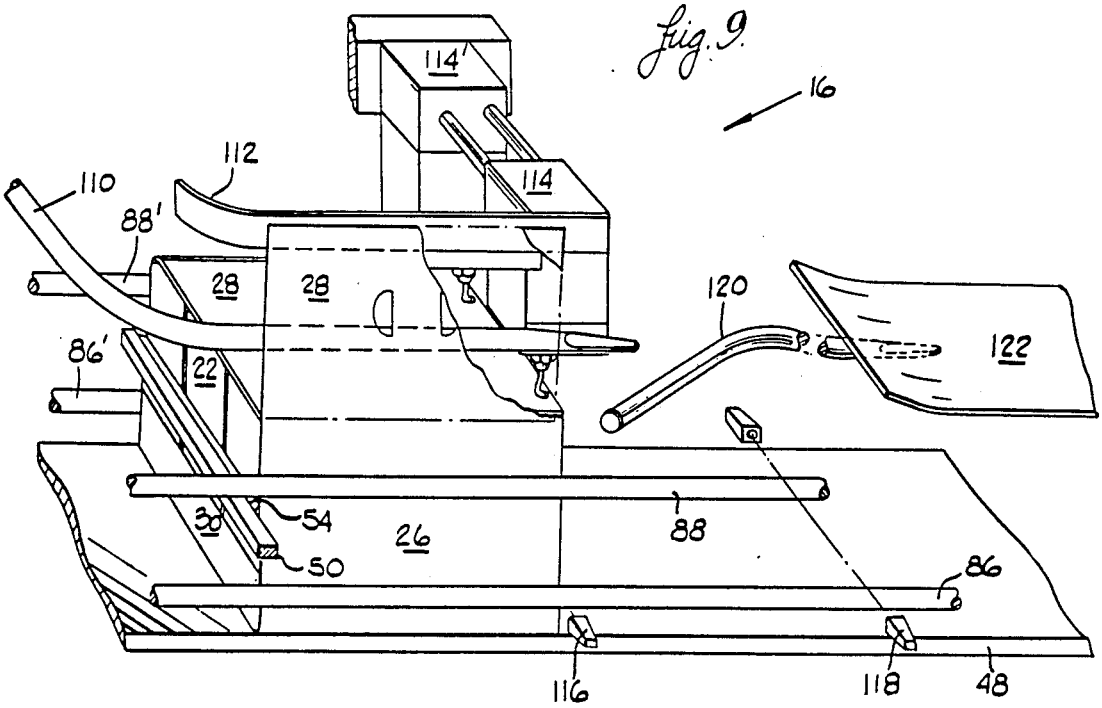

Referring now to FIG. 9, glue guns 114, 114' and electronic eyes 116, 116' and 118, 118' are illustrated. The glue guns are mounted adjacent but spaced inwardly from the vertical plane of the side edges of the bed plate 48. The lower ends of the glue guns 114, 114' are spaced just above the upper surface of the inner top panel of the carton 20. Just downstream from the glue guns 114, 114' is the first set of electronic eyes 116, 116'. When the carton interrupts the light between the electronic eyes 116, 116', the glue guns are actuated. Spaced downstream from the first set of electronic eyes 116, 116' a distance less than the length of the carton 20 is the second set of electronic eyes 118, 118'. When the carton interrupts the light between the electronic eyes 118, 118', the glue guns are deactivated.

With this construction, as the carton 20 passes beneath the glue guns 114, 114', the inner top panel is held down on the containers 22 and the outer top panel is held upright and out of the way. The glue guns are actuated just after the leading end of the carton passes the glue guns and are deactivated just before the trailing end of the carton passes from beneath the glue guns 114, 114'.

Figure 10:
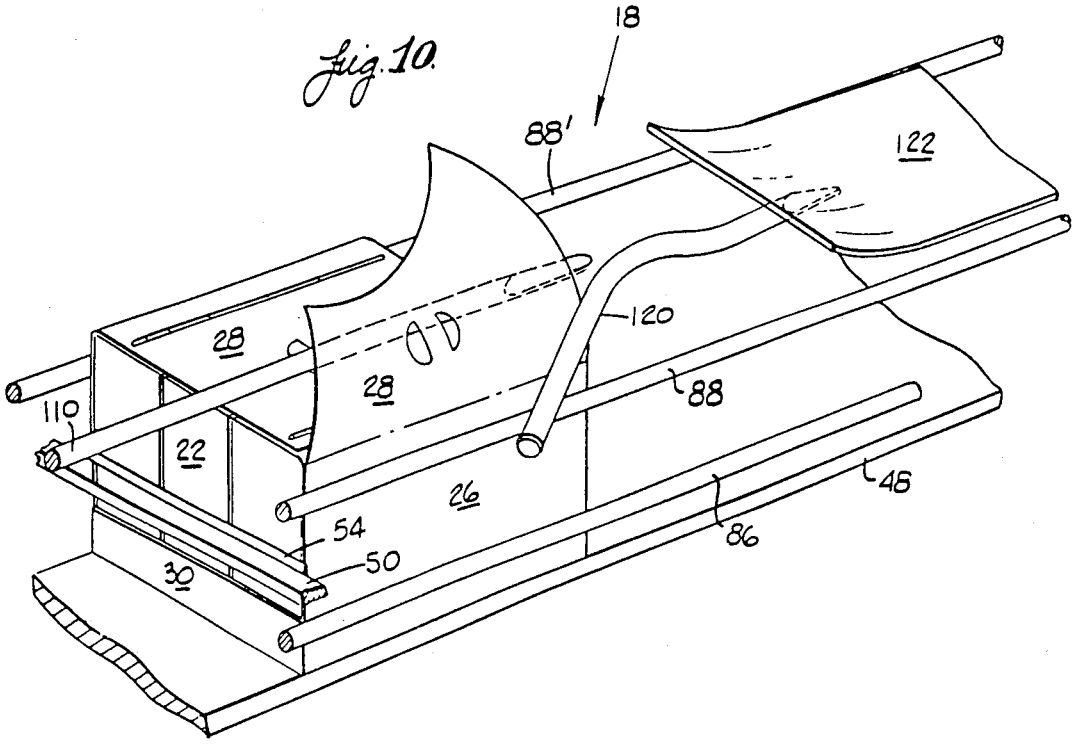
Figure 11:
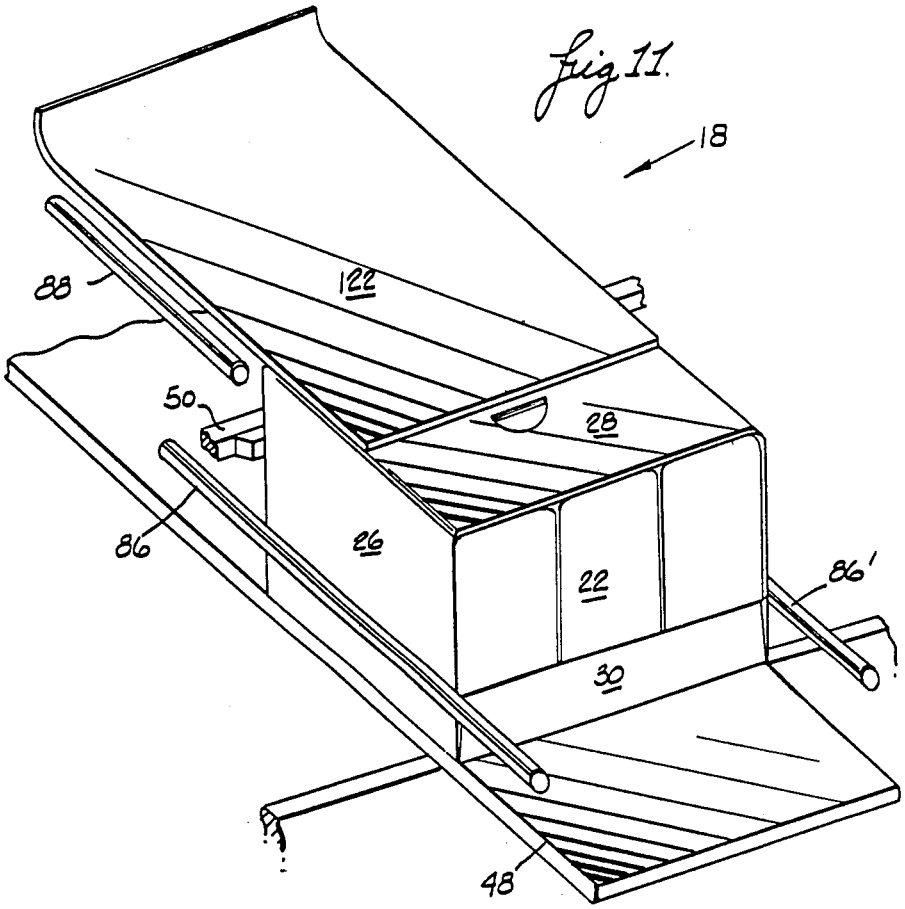

As shown in FIGS. 10 and 11, after the beads of adhesive have been applied to the upper surface of the inner top panel, the carton passes into the sealing station 18 of the machine. The sealing station includes a fold down bar 120 and a compression plate 122. The fold down bar 120 has a leading end which extends outwardly beyond the vertical plane of the side edge of the bed plate 48. The fold down bar 120 extends inwardly and down from its leading end in the downstream direction. At the centerline of the bed plate 48 the fold down bar 120 extends parallel to the center line of the bed plate to the compression plate 122 at a height substantially equal to the height of the containers 22. The compression plate 122 is centered over the bed plate 48 at a height substantially equal to the height of the containers 22. The width of the compression plate is greater than the width of the bed plate and the leading end of the compression plate is curved upwardly to receive the carton 20.

With this construction, after the adhesive has been applied to the upper surface of the inner top panel of the carton and the outer top panel passes beyond guide bar 112, the outer top panel is folded down onto the inner top panel by the fold down bar 120 as the carton moves downstream. Once the outer top panel is folded down onto the inner top panel, the carton passes beneath the compression plate 122 where the inner and outer panels are pressed together until the adhesive sets.

What is claimed is:

1. A machine for packaging a plurality of articles in a wrap-around carton wherein the carton has a bottom panel, two side panels, inner and outer top panels and end panels connected to the side panels by tuck flaps comprising:

means for segregating a selected number of articles to be packaged from an infeed conveyor, said segregating means comprising an elevating means for elevating the selected articles from the level of the infeed conveyor to the level of a machine bedplate while holding back other articles on the infeed conveyor;

means for engaging the articles to transport the selected articles downstream through the machine until the packaging operation is completed;

said means comprising spaced apart flight bars, said flight bars each having a container engaging protrusion centrally located on a downstream side of a respective flight bar, said protrusion extending less than a full width of said respective flight bar for engaging the selected articles so as to avoid interference with the formation of the carton about the articles;

means for feeding a substantially flat carton blank beneath the selected articles as the articles are transported downstream through the machine with the bottom panel of the carton being located beneath the articles, the side panels and top panels being located on the sides of the articles and the end panels leading and trailing the articles;

means for engaging the tuck flaps of the carton blank and the side panels of the carton blank to elevate and retain side panels, top panels and end panels to upright positions around the selected articles while the carton is being formed from the blank, said means for engaging the tuck flaps causing the tuck flaps to be positioned between the side panels and the selected articles;

means for folding the inner top panel down onto the selected articles and retaining the inner top panel there while adhesive is applied to at least one of the top panels;

means for applying adhesive to at least one of the top panels;

means for folding the outer top panel down onto the inner top panel and for pressing the top panels together until the adhesive has set and the selected articles are packaged.

2. The machine of claim 1 in which:

the protrusions of the flight bars have a width that is no greater than the width of the selected articles to avoid interference with side panels.

3. The machine of claim 2 in which:

the protrusions of the flight bars have a predetermined depth to avoid interference with a trailing end panel.

* * * * *